US008561705B2

(12) United States Patent
Wilson

(10) Patent No.: US 8,561,705 B2
(45) Date of Patent: Oct. 22, 2013

(54) LEAD IMPRESSION WEAR BUSHING

(75) Inventor: Thomas McCreath Wilson, Aberdeen (GB)

(73) Assignee: Vetvo Gray Inc., Houston, TX (US)

( * ) Notice: Subject to any disclaimer, the term of this patent is extended or adjusted under 35 U.S.C. 154(b) by 272 days.

(21) Appl. No.: 13/086,038

(22) Filed: Apr. 13, 2011

(65) Prior Publication Data

US 2012/0261132 A1 Oct. 18, 2012

(51) Int. Cl.
*E21B 7/12* (2006.01)

(52) U.S. Cl.
USPC ..... 166/336; 166/339; 166/351; 166/358

(58) Field of Classification Search
USPC ..... 166/336, 339, 348, 351, 358, 368, 166/250.01, 255.1, 255.2, 250.09, 85.3
See application file for complete search history.

(56) References Cited

U.S. PATENT DOCUMENTS

| | | | | | |
|---|---|---|---|---|---|
| 3,960,215 | A | | 6/1976 | Mitchell | |
| 3,983,906 | A | | 10/1976 | Hutchison et al. | |
| 4,295,665 | A | * | 10/1981 | Pierce | 285/3 |
| 4,340,259 | A | * | 7/1982 | Green | 384/29 |
| 4,408,784 | A | * | 10/1983 | Reimert | 285/24 |
| 4,422,507 | A | * | 12/1983 | Reimert | 166/348 |
| 4,496,172 | A | * | 1/1985 | Walker | 285/18 |
| 4,616,987 | A | * | 10/1986 | Boyers et al. | 425/89 |
| 4,674,576 | A | * | 6/1987 | Goris et al. | 166/382 |
| 4,736,799 | A | * | 4/1988 | Ahlstone | 166/348 |
| 4,770,248 | A | * | 9/1988 | Houlgrave et al. | 166/341 |
| 4,880,061 | A | * | 11/1989 | Ahlstone | 166/348 |
| 4,995,458 | A | * | 2/1991 | Garbett | 166/85.3 |
| 5,025,864 | A | | 6/1991 | Nobileau | |
| 5,044,438 | A | * | 9/1991 | Young | 166/382 |
| 5,069,287 | A | * | 12/1991 | Short et al. | 166/339 |
| 5,199,495 | A | | 4/1993 | Brammer et al. | |
| 5,360,063 | A | | 11/1994 | Henderson, Jr. et al. | |
| 5,372,201 | A | * | 12/1994 | Milberger | 166/382 |
| 5,620,052 | A | * | 4/1997 | Turner | 166/348 |
| 5,791,418 | A | * | 8/1998 | Milberger et al. | 166/368 |
| 6,260,618 | B1 | | 7/2001 | Davis et al. | |
| 6,302,211 | B1 | * | 10/2001 | Nelson et al. | 166/348 |
| 6,516,861 | B2 | | 2/2003 | Allen | |
| 6,615,921 | B2 | | 9/2003 | Whitelaw et al. | |
| 6,719,044 | B2 | * | 4/2004 | Ford et al. | 166/85.3 |

(Continued)

FOREIGN PATENT DOCUMENTS

| | | | |
|---|---|---|---|
| EP | 2239411 | A2 | 10/2010 |
| GB | 2199870 | A | 7/1988 |

OTHER PUBLICATIONS

GB Search Report and Opinion dated Jul. 19, 2012 from corresponding Application No. GB1205967.1.

*Primary Examiner* — Matthew Buck
*Assistant Examiner* — Aaron Lembo
(74) *Attorney, Agent, or Firm* — Bracewell & Giuliani LLP

(57) ABSTRACT

A wear bushing having a lead impression block is landed axially above a casing hanger and actuated to test an elevation of lock ring grooves formed in a wellhead. Then, drilling operations are performed through the wear bushing. The wear bushing includes a first tubular member having an axis and a second tubular member coaxial with the first tubular member. The second tubular member moves down to actuate a lead impression assembly to measure an elevation within the wellhead with the lead impression block. After the drilling operations are completed, the deformed lead impression block is retrieved along with the wear bushing.

18 Claims, 7 Drawing Sheets

(56) References Cited

U.S. PATENT DOCUMENTS

| | | | | |
|---|---|---|---|---|
| 6,749,018 | B1 | 6/2004 | Ford et al. | |
| 6,945,325 | B2 | 9/2005 | Ford et al. | |
| 6,966,381 | B2 | 11/2005 | Stjernstrom | |
| 7,143,830 | B2 * | 12/2006 | Bartlett | 166/339 |
| 7,237,613 | B2 | 7/2007 | Radi et al. | |
| 7,360,601 | B2 | 4/2008 | See | |
| 7,647,973 | B2 | 1/2010 | Minassian et al. | |
| 7,743,832 | B2 * | 6/2010 | Shaw et al. | 166/338 |
| 8,322,441 | B2 * | 12/2012 | Fenton | 166/368 |
| 2002/0023748 | A1 * | 2/2002 | Elliott | 166/173 |
| 2005/0211442 | A1 | 9/2005 | McGuire et al. | |
| 2010/0006301 | A1 | 1/2010 | Fenton | |
| 2010/0243271 | A1 | 9/2010 | Minassian et al. | |
| 2011/0114337 | A1 * | 5/2011 | Nguyen | 166/381 |
| 2012/0024541 | A1 * | 2/2012 | Gette et al. | 166/382 |

* cited by examiner

LEAD IMPRESSION WEAR BUSHING

BACKGROUND OF THE INVENTION

1. Field of the Invention

This invention relates in general to wear bushings and, in particular, to a wear bushing that measures the elevation of lock ring grooves on an inner diameter of a wellhead housing prior to running a lockdown hanger or locking ring bridging hanger.

2. Brief Description of Related Art

Following setting of a casing hanger, a wear bushing is often landed axially above the casing hanger. This is done prior to further drilling operations that may be conducted axially downhole from the casing hanger. The wear bushing protects the casing hanger and wellhead housing from damage and wear that might be caused by the drill bit and drill string during these operations downhole from the casing hanger. Generally, the casing hanger is set, then a casing hanger running tool that was used to land and set the casing hanger is pulled from the wellbore. A wear bushing running and retrieval tool is coupled to the drill string in place of the casing hanger running tool. The wear bushing running and retrieval tool runs, lands, and sets the wear bushing. After landing the wear bushing, the wear bushing running and retrieval tool may pressure test the wear bushing to ensure that the wear bushing has properly landed on the casing hanger.

Following a successful pressure test, the wear bushing running and retrieval tool is decoupled from the wear bushing and pulled from the wellbore. Various drilling tools may then be attached to the drill string in place of the wear bushing running and retrieval tool. The drilling tools are then run downhole past the wear bushing and the casing hanger to conduct drilling operations. Preferably, the drill tool and drill string will pass through a bore of the casing hanger without contacting or damaging the inner diameter or the rim of the casing hanger. However, if the drill tool is misaligned relative to the casing hanger, the drill tool may contact and damage the casing hanger as it passes through the casing hanger. If a wear bushing is landed axially above the casing hanger, the drill tool will first contact the wear bushing, and, as the drill tool passes through the wear bushing, it will come into alignment with the casing hanger. Thus, the wear bushing protects the casing hanger. In addition, if the drill string rotates eccentrically during the drilling operation, the drill string will contact and wear the wear bushing rather than the casing hanger, thus protecting the casing hanger. After performance of the desired drilling operations, the drill string and the drill tool will be pulled from the wellbore. The wear bushing running and retrieval tool may then be coupled to the drill string in place of the drill tool, and then be run to the wear bushing to pull the wear bushing from the wellbore.

Typically, a lockdown hanger may then be run downhole to land and set above the casing hanger to provide additional casing lockdown capability. The lockdown hanger may be needed due to thermal expansion of the casing string. Lockdown hangers improve long-term seat reliability below the lockdown hanger by sharing the cyclic axial loads applied to the casing hanger. To properly land and set a lockdown hanger, the lockdown hanger must be run proximate to lock-ring grooves formed in the subsea wellhead axially above the casing hanger. After landing, a grooved ring of the lockdown hanger will actuate to engage the lock-ring grooves, thereby properly securing the lockdown hanger to the wellhead and casing hanger. Operation of the rig would generally require running of a lead impression tool prior to running and setting of the lockdown hanger. The lead impression tool determines the elevation of the lock-ring grooves for proper landing of the lockdown hanger. However, this step is often bypassed due to the costs associated with performing an additional tool trip with the drilling rig. Typically, the lockdown hanger is run, landed, and set without checking the locking ring groove elevation. If there is a problem with the lockdown hanger, the lockdown hanger may then be removed and the elevation of the locking ring grooves checked with the lead impression tool. This adds an additional downhole trip and can significantly increase the costs associated with completion of a well. Therefore, a lead impression tool that determined lock-ring groove elevation without requiring an additional rig trip would be useful in ensuring more efficient rig operation and fewer problems in completion of the well.

SUMMARY OF THE INVENTION

These and other problems are generally solved or circumvented, and technical advantages are generally achieved, by preferred embodiments of the present invention that provide a lead impression wear bushing, and a method for using the same.

In accordance with an embodiment of the present invention, a subsea wellhead assembly is disclosed. The subsea wellhead assembly includes a subsea wellhead having a bore containing a grooved profile, and a casing hanger landed in the bore below the profile. A wear bushing is retrievably landed in the bore, and shields the profile and an inner part of the casing hanger from drilling tools that pass through the wear bushing. An impression block formed of a deformable material is carried by the wear bushing. An actuator is housed within the wear bushing and is moveable in response to landing of the wear bushing to force the block into the profile to cause the block to form an impression of the profile for subsequent inspection when the wear bushing is retrieved.

In accordance with another embodiment of the present invention, a wear bushing for disposition within a wellhead is disclosed. The wear bushing includes a first tubular member having an axis, and at least one impression assembly housed within the first tubular member and radially moveable between a retracted and an extended position relative to the first tubular member. The wear bushing also includes a second tubular member coaxial with the first tubular member. The second tubular member is axially moveable between run-in and set positions relative to the first tubular member. Axial movement of the second tubular member to the set position will cause the impression assembly to move from the retracted to the extended position into engagement with a wellhead member profile. The impression assembly includes a permanently deformable block for creating an imprint of the profile. The wear bushing includes a latch mounted to one of the tubular members to latch the first and second tubular members in the wellhead, and a seal mounted to one of the tubular members to seal the first and second tubular member to the wellhead. The first and second tubular members of the wear bushing have bores sized for the passage of drilling tools.

In accordance with yet another embodiment of the present invention, a method for performing operations through and in a subsea wellhead is disclosed. The method begins by mounting an impression block in a wear bushing, and then running the wear bushing subsea and landing the wear bushing within the wellhead such that the impression block is adjacent a selected profile within the wellhead. The method then moves the impression block outward and deforms the impression block against the profile in the wellhead. The method continues by lowering a drill string through the wear bushing and wellhead and rotating the drill string to perform drilling activities. The wear bushing is then retrieved along with the deformed impression block. The method continues by inspecting the impression block to ascertain a location of the profile.

An advantage of a preferred embodiment is that the disclosed lead impression wear bushing allows an elevation of lock ring grooves within a wellhead to be checked while other drilling operations are conducted. This saves a trip down the wellbore because a separate tool need not be used to check the elevation.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, casing hanger landing and setting, and the like have been omitted inasmuch as such details are not considered necessary to obtain a complete understanding of the present invention, and are considered to be within the skills of persons skilled in the relevant art.

Figure 1:
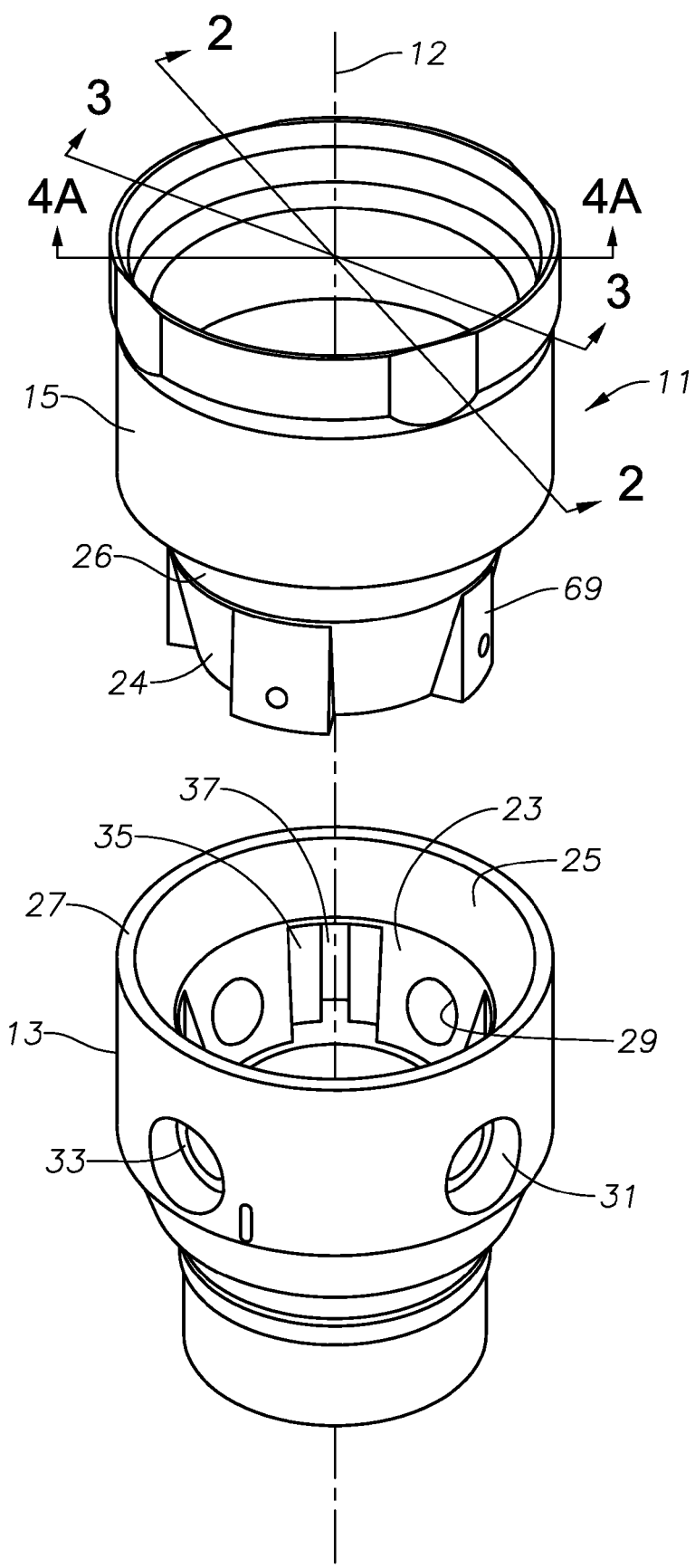
FIG. 1 is a perspective view of two primary tubular members of a lead impression wear bushing.
Figure 2A:
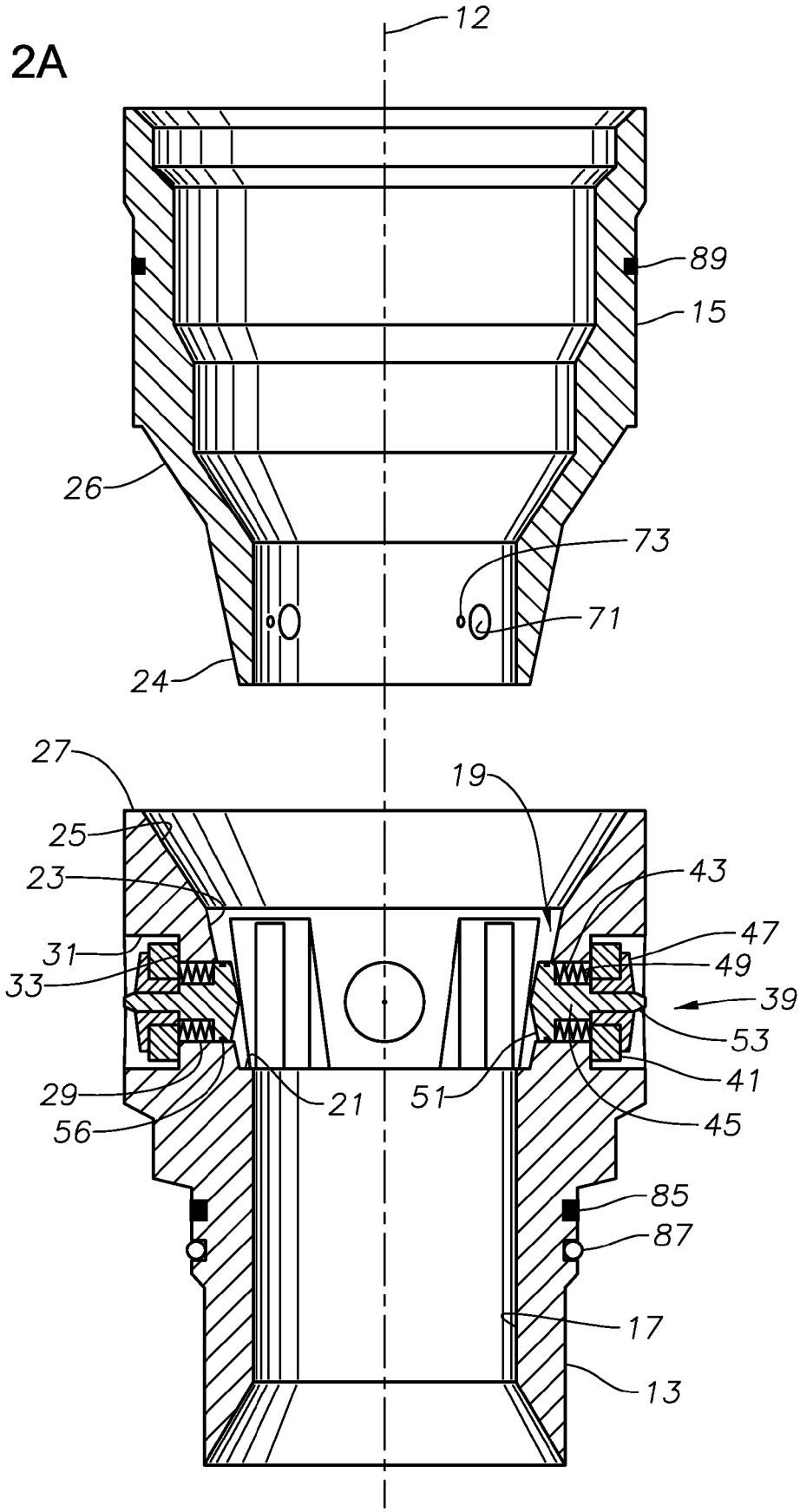
FIG. 2A is a sectional view of the lead impression wear bushing of FIG. 1 including sub assemblies taken along line 2-2.

Referring to FIG. 1, a lead impression wear bushing 11 having an axis 12 includes a lead assembly wear bushing 13 and an actuation wear bushing 15. Lead assembly wear bushing 13 may be a tubular member having a central bore 17 as shown in FIG. 2A. A counterbore 19 is located at an upper end of central bore 17 of lead assembly wear bushing 13. Counterbore 19 extends from the upper end of lead assembly wear bushing 13 to an upward facing annular shoulder 21 formed on an interior diameter portion of lead assembly wear bushing 13 at the transition from counterbore 19 to central bore 17. Counterbore 19 includes a first tapered surface 23 extending at a first angle from shoulder 21 to a second tapered surface 25. Second tapered surface 25 extends from first tapered surface 23 at a second angle to an upper rim 27 of lead assembly wear bushing 13. In the illustrated embodiment, first tapered surface 23 has a greater slope than second tapered surface 25.

Figure 3:
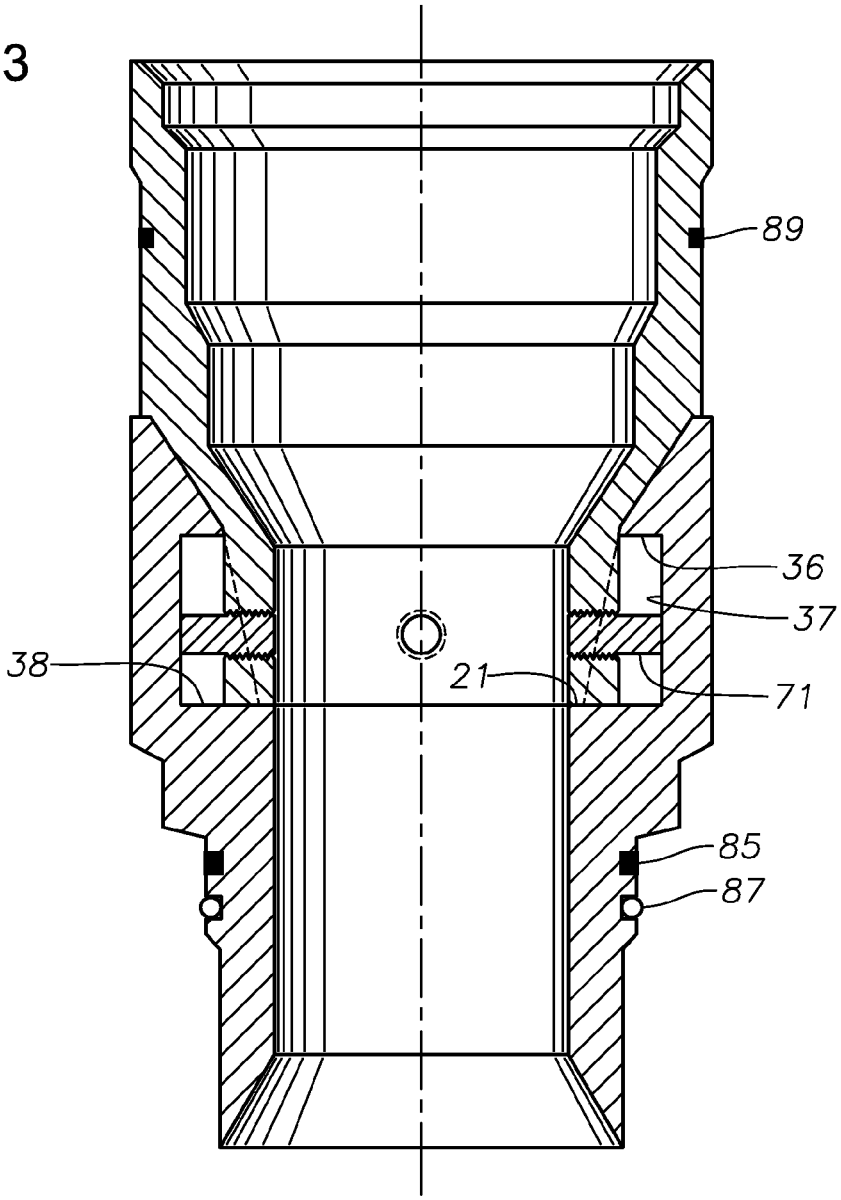
FIG. 3 is a sectional view of the lead impression wear bushing of FIG. 1 taken along line 3-3.

Lead assembly wear bushing 13 includes windows 29 extending radially outward from tapered surface 23 to an exterior diameter surface of lead assembly wear bushing 13. In the illustrated embodiment, there are four windows 29. A person skilled in the art will understand that more or fewer windows 29 may be included in alternative embodiments. Each window 29 includes a counterbore 31 extending radially inward from the exterior diameter surface of lead assembly wear bushing 13 to a radially outward facing shoulder 33. As shown in FIG. 1, lead assembly wear bushing 13 also includes actuation wear bushing slots 35 formed in first tapered surface 23. Wear bushing slots 35 extend axially downward to upward facing shoulder 21 from the transition between second tapered surface 25 and first tapered surface 23. Actuation wear bushing slots 35 have an inner diameter surface that is substantially vertical and parallel to axis 12. A guidance recess 37 is formed within each actuation wear bushing slot 35 and extends from the substantially vertical inner diameter surface of actuation wear bushing slot 35 radially outward terminating at a vertical surface parallel to axis 12. Each guidance recess 37 has an upper and lower shoulder 36, 38 as shown in FIG. 3.

Referring to FIG. 2A, an actuator, such as lead impression assembly 39, is mounted within each window 29. Each lead impression assembly 39 includes a coupling ring 41, a biasing spring 43, a lead impression piston 45, and an impression block or cartridge such as lead impression block 47. The impression block, such as lead impression block 47, is permanently deformable so that an imprint of a profile may be created in the impression block when pressed into the profile. Coupling ring 41 is mounted to shoulder 33 within counterbore 31 by any suitable means such as with the illustrated bolts. An inner diameter of coupling ring 41 is smaller than the diameter of window 29 such that coupling ring 41 will form a radially inward facing shoulder 49.

Figure 2B:
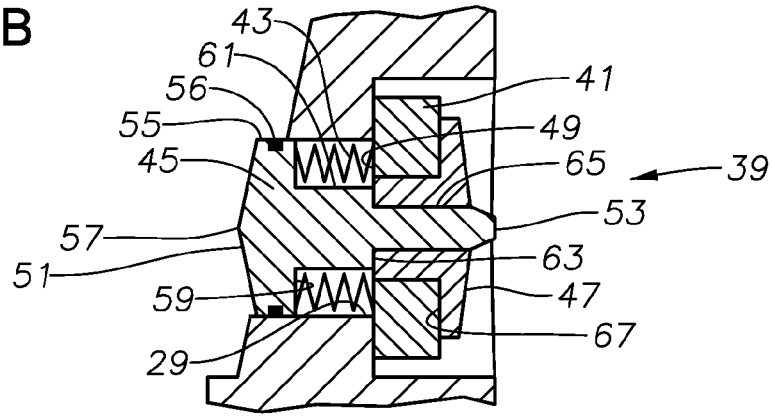
FIG. 2B is a sectional view of a portion of the lead impression wearing bushing of FIG. 2A.
Figure 6:
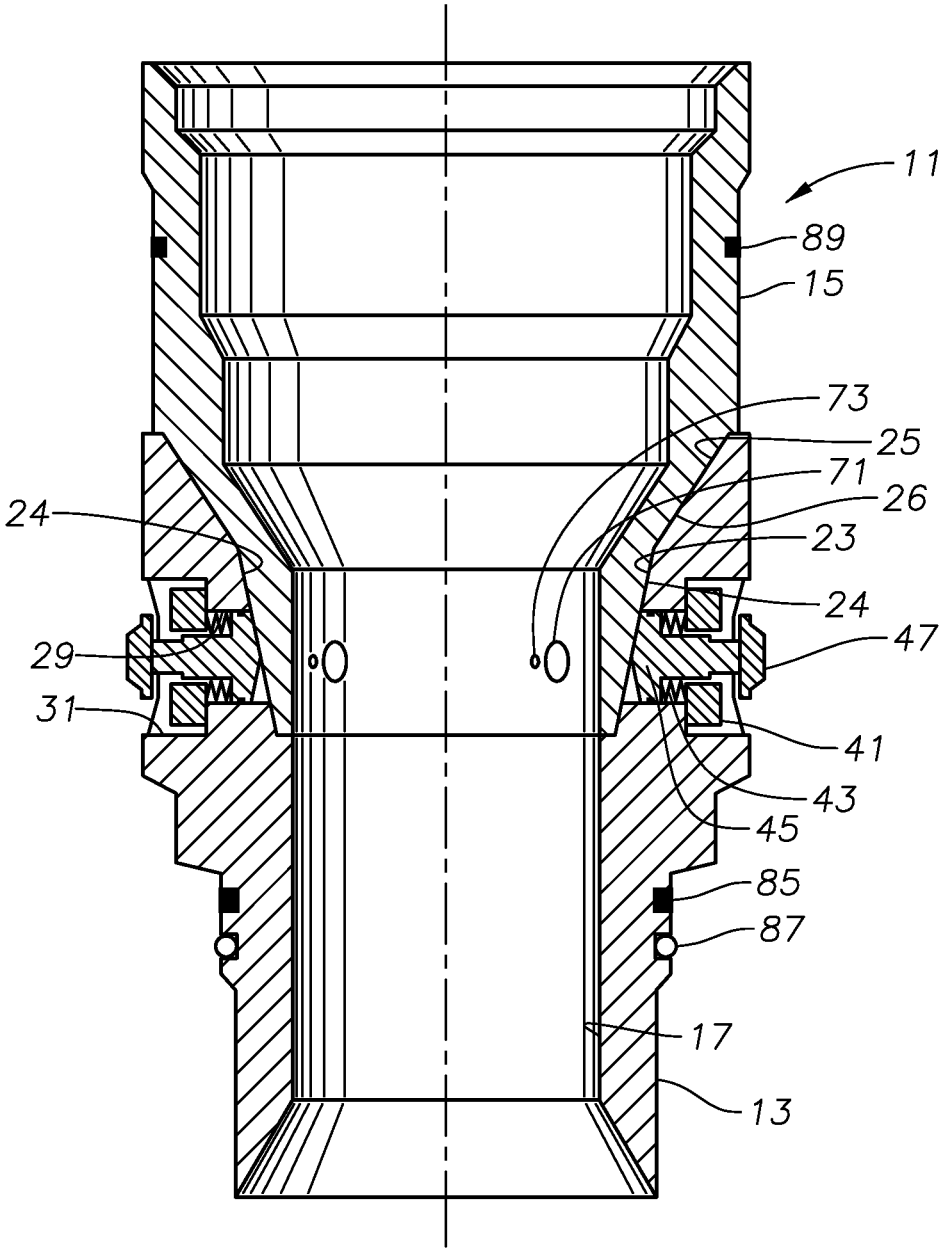
FIG. 6 is a sectional view of the lead impression wear bushing of FIG. 1 taken along line 2-2 after setting of the lead impression wear bushing.

Referring to FIG. 2B, lead impression piston 45 may be a cylindrical object as shown having a radially inward piston head 51 and a radially outward end 53. Piston head 51 may be a conical surface having an exterior diameter 55 substantially equivalent to the diameter of window 29. The conical surface of end 51 forms an angle extending from apex 57 at a center of piston head 51 to exterior diameter 55 of piston head 51. The angle is substantially equivalent to the angle of first tapered surface 23 of FIG. 2A. As shown in FIG. 2B, piston head 51 includes a sealing ring 56 on an exterior diameter surface of piston head 51. Sealing ring 56 is adapted to form a pressure seal when piston head 51 moves into window 29 as shown in FIG. 6. In this manner, lead impression wear bushing 11 may be pressure tested prior to running of a drill tool and drill string to ensure proper setting of lead impression wear bushing 11. Referring to FIG. 2B, piston head 51 defines a radially outward facing shoulder 59 opposite shoulder 49 of coupling ring 41. Lead impression piston 45 has an inner shank 61 extending from outward facing shoulder 59 to a lead block shoulder 63. Inner shank 61 has an exterior diameter less than the diameter of window 29, such that the exterior diameter surface of inner shank 61 defines an annular cavity between outward facing shoulder 59, coupling ring shoulder 49, and the inner diameter surface of window 29. Biasing spring 43 mounts within this cavity and has a first end abutting shoulder 49 of coupling ring 41, and a second end abutting shoulder 59 of piston head 51 such that movement of piston 45 radially outward will compress biasing spring 43.

As shown in FIG. 2B, biasing spring 43 is un-displaced. When compressed, biasing spring 43 exerts a radially inward force on shoulder 59 of piston head 51 biasing piston 45 to the position shown in FIG. 2A and FIG. 2B. Biasing spring 43 may be disc springs or any other suitably sprung device such that biasing spring 43 will bias piston 45 to the radially inward or retracted position of FIG. 2A and FIG. 2B. Biasing spring 43 has a central opening allowing for the passage of inner shank 61 of piston 45.

Inner shank 61 transitions to a lead impression block shank 65 at lead block shoulder 63. Lead impression block shank 65 has an exterior diameter that is less than the inner diameter of coupling ring 41. Lead impression block 47 mounts to lead impression block shank 65 in any suitable manner, such as with a bushing and bolt assembly as shown. Lead impression block 47 has an inner diameter shoulder 67 configured to abut an exterior diameter surface of coupling ring 41. In this manner, lead impression block 47 will limit the radially inward movement of piston 45 through abutment of shoulder 67 with coupling ring 41 when in the retracted position.

Referring to FIG. 2A, actuation wear bushing 15 has an upper end with an exterior diameter substantially equivalent to the exterior diameter of the upper end of lead assembly wear bushing 13. A lower end of actuation wear bushing 15 is adapted to insert into counterbore 19 of lead assembly wear bushing 13. The lower end of actuation wear bushing 15 is tapered at two angles so that the exterior diameter surface of the lower end of actuation wear bushing 15 will have a third tapered surface 24 abutting first tapered surface 23 and a fourth tapered surface 26 abutting second tapered surface 25 of lead impression wear bushing 13. Actuation wear bushing 15 includes ribs 69 (FIG. 1) formed on the exterior diameter surface of the lower end of actuation wear bushing 15 along third tapered surface 24. Each rib 69 will substantially fill a respective slot 35 (FIG. 1) of lead assembly wear bushing 13 when actuation wear bushing 15 is fully inserted into lead assembly wear bushing 13 as shown in FIG. 3.

Referring to FIG. 3, a guidance pin 71 is inserted into a bore in each rib 69. In the illustrated embodiment the bores in each rib 69 are threaded and each guidance pin 71 is threaded through a corresponding bore so that a radially outward end of each guidance pin 71 inserts into a respective recess 37. Guidance pins 71 will allow actuation wear bushing 15 to move axially relative to lead assembly wear bushing 13 by traveling axially through recess 37. Axial movement of actuation wear bushing 15 relative to lead assembly wear bushing 13 will be limited by abutment of guidance pin 71 with upper shoulder 36 and abutment of a lower rim of actuation wear bushing 15 with upward facing shoulder 21 of lead assembly wear bushing 13. In the illustrated embodiment, guidance pins 71 support the weight of lead assembly wear bushing 13 during running and retrieval operations.

Figure 4A:
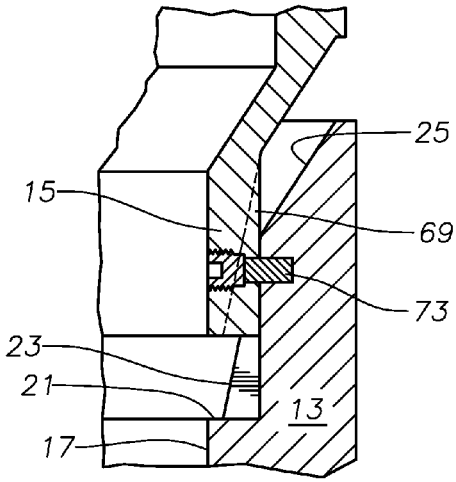
FIG. 4A is a sectional view of a portion of the lead impression wear bushing of FIG. 1 taken along line 4A-4A.

As shown in FIG. 2A, shear elements 73 pass through bores in actuation wear bushing 15 adjacent to guidance pins 71. Shear elements 73 insert into corresponding bores (not shown) in lead assembly wear bushing 13 and prevent axial movement of actuation wear bushing 15 relative to lead assembly wear bushing 13 prior to shearing of shear elements 73. As shown in FIG. 4A, shear elements 73 hold actuation wear bushing 15 at an elevated position relative to lead assembly wear bushing 13 during running of lead impression wear bushing 11. In the illustrated embodiment, shear elements 73 are threaded into actuation wear bushing 15 and lead assembly wearing bushing 13 from an interior diameter of actuation wear bushing 15. A person skilled in the art will understand that shear elements 73 may be threaded into lead assembly wear bushing 13 from an exterior diameter of lead assembly wear bushing 13 and then into actuation wear bushing 15. Shear elements 73 may include a seal allowing shear elements 73 to seal to either lead assembly wear bushing 13 or actuation wear bushing 15 to prevent passage of fluid from an interior of lead impression wear bushing 11 to an exterior of lead impression wear bushing 11 and vice versa.

Figure 4B:
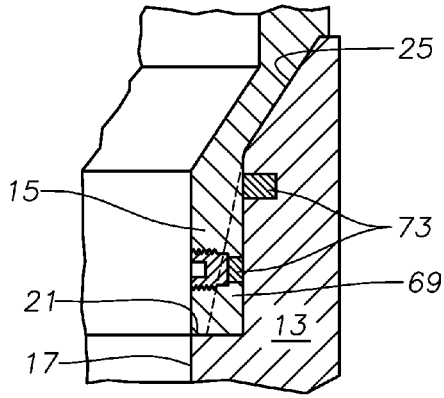
FIG. 4B is a sectional view of the portion of the lead impression wear bushing of FIG. 4A following an operational step of the lead impression wear bushing.
Figure 4C:
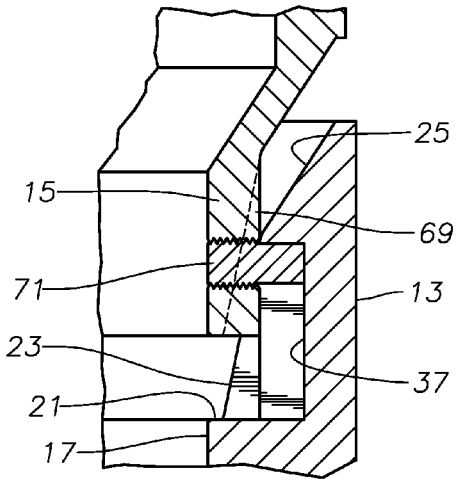
FIG. 4C is a sectional view of a portion of the lead impression wear bushing of FIG. 1 taken along line 3-3.
Figure 4D:
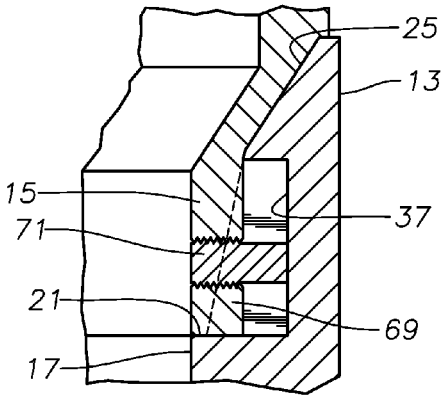
FIG. 4D is a sectional view of the portion of the lead impression wear bushing of FIG. 4C following an operational step of the lead impression wear bushing.

After landing lead impression wear bushing 11, described in more detail below, set down weight will be applied to actuation wear bushing 15, shearing shear elements 73 as shown in FIG. 4B. Referring to FIG. 4C, guidance pins 71 will be in the position shown during running and retrieval of lead impression wear bushing 11. Again, after landing of lead impression wear bushing 11 and shearing of shear elements 73 (not shown in FIG. 4C), actuation wear bushing 15 will move axially downward relative to lead assembly wear bushing 13 landing a lower rim of actuation wear bushing 15 on shoulder 21 of lead assembly wear bushing 13 as shown in FIG. 4D.

Figure 5:
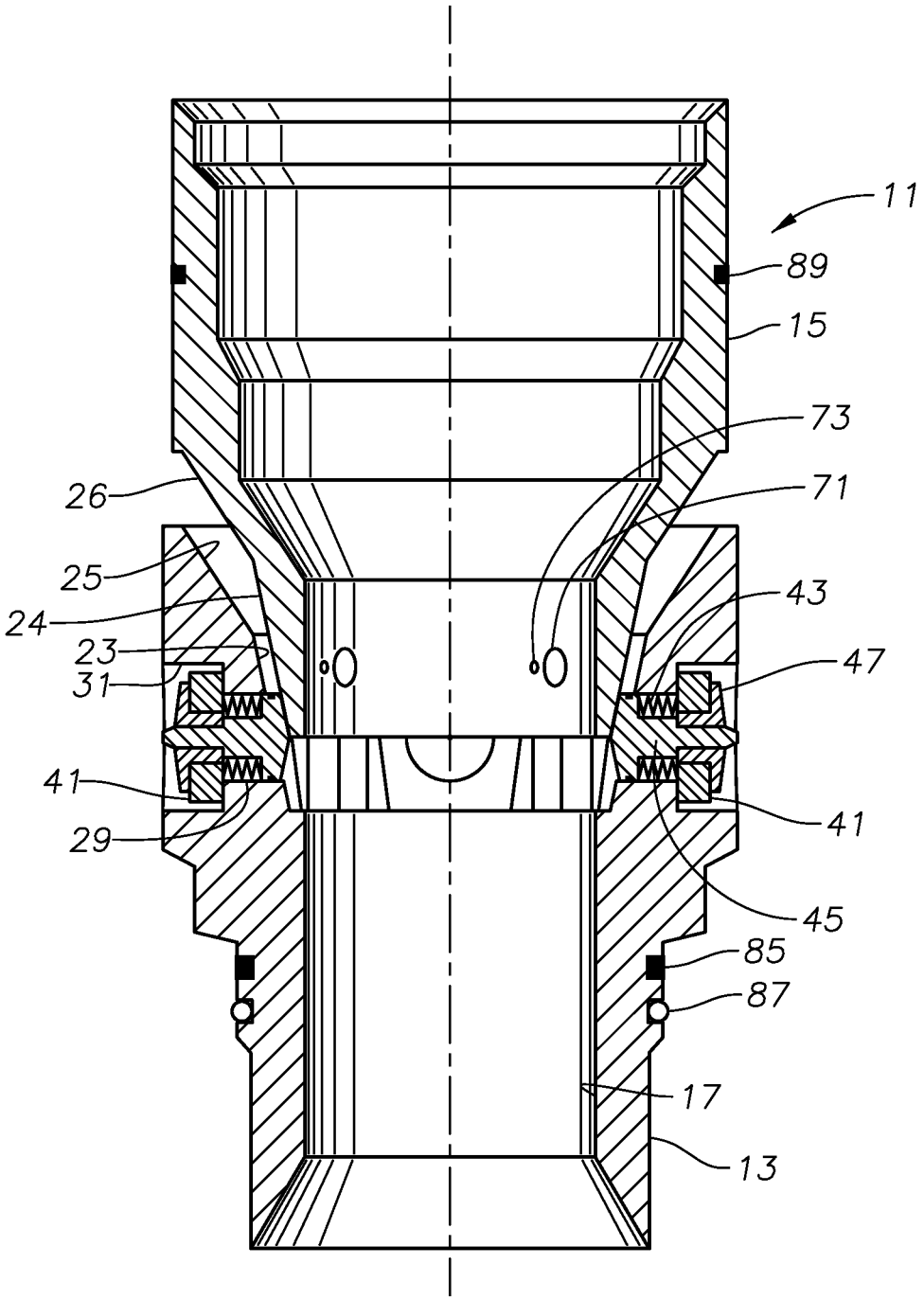
FIG. 5 is a sectional view of the lead impression wear bushing of FIG. 1 taken along line 2-2 during a running operation.

Referring to FIG. 5, lead impression wear bushing 11 is shown in the running or run-in position. Shear elements 73 and guidance pins 71 are in the positions shown in FIGS. 4A and 4C, respectively. Actuation wear bushing 15 will contact, but not yet cause radial movement of piston 45. Referring to FIG. 5, after landing on a casing hanger as described below, set down weight will be applied to actuation wear bushing 15, causing shear elements 73 to shear and actuation wear bushing 15 to move axially downward in response. As actuation wear bushing 15 moves axially downward into a set position as shown in FIG. 6, third tapered surface 24 will move piston 45 radially outward as third tapered surface 24 moves into contact with first tapered surface 23, compressing biasing spring 43. As piston 45 moves radially outward, the coupled lead impression block 47 will move out of counterbore window 31 such that impression assembly 39 is in an extended position, as shown in FIG. 6.

During retrieval of lead impression wear bushing 11, an upward axial force is applied to actuation wear bushing 15, causing actuation wear bushing 15 to move upward axially in response. Actuation wear bushing 15 will initially move upward relative to lead impression wear bushing 13 until pins 71 land on downward facing shoulder 36 of recess 37. This will cause third tapered surface 24 to move out of contact with first tapered surface 23. As third tapered surface 24 moves out of contact with first tapered surface 23, biasing springs 43, compressed by pistons 45, such that springs 43 exert a radially inward force on pistons 45, will cause pistons 45 to move radially inward. As a result, lead impression blocks 47 will move radially inward to the retracted position within counterbore window 31 shown in FIG. 5.

Figure 7:
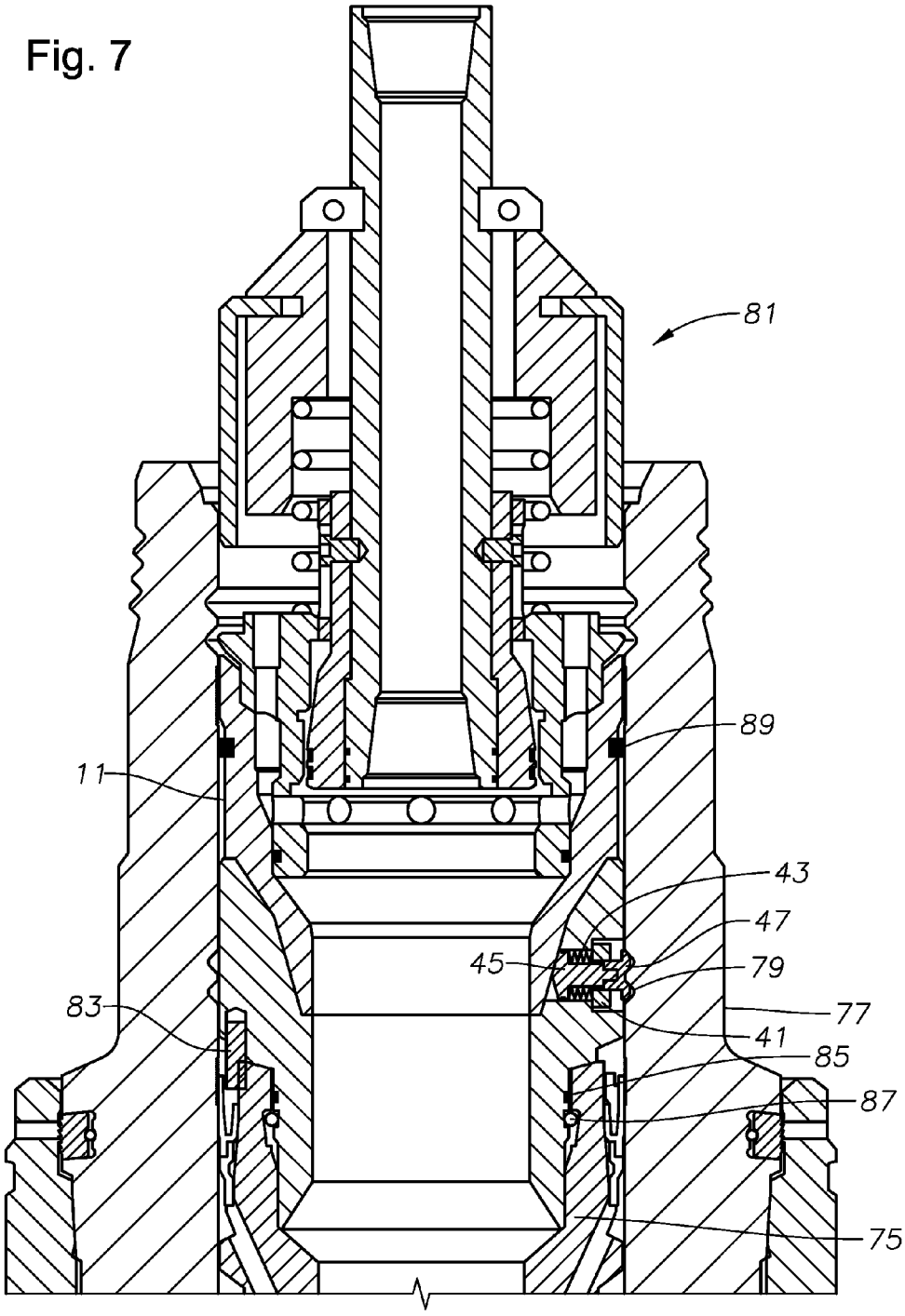
FIG. 7 is a sectional view of the lead impression wear bushing of FIG. 1 landed in place in a subsea wellhead.

Referring now to FIG. 7, lead impression wear bushing 11 is shown disposed within a casing hanger 75 in place within a subsea wellhead 77. Lead impression wear bushing 11 is coupled to a wear bushing running and retrieval tool 81 and run to the position shown in FIG. 7. This is done while still on the rig deck by first stabbing a lower end of wear bushing running and retrieval tool 81 into the lead impression wear bushing 11 until a stop ring of wear bushing running and retrieval tool 81 bottoms out on an inner diameter shoulder of lead impression wear bushing 11. Wear bushing running and retrieval tool 81 is then lifted up to engage slips of wear bushing running and retrieval tool 81 with the inner diameter surface of lead impression wear bushing 11.

The combined assembly is then run into the wellbore to land at the position shown in FIG. 7. The tool set down weight is then applied by wear bushing running and retrieval tool 81 to move lead impression blocks 47 into engagement with lock-ring grooves 79, as described above with respect to FIGS. 4-6. A person skilled in the art will understand that the impression blocks, such as lead impression blocks 47 shown herein, may be formed of any suitable material, provided the material is deformable by the associated profile in the wellhead. Referring to FIG. 7, as lead impression blocks 47 engage lock-ring grooves 79, lead impression blocks 47 will deform to provide a minor image of the profile of lock-ring grooves 79 above casing hanger 75. Running tool 81 may then pressure test lead impression wear bushing 11 prior to removal of running tool 81 and further drilling operations. A pressure test of lead impression wear bushing 11 may then be conducted through wear bushing running and retrieval tool 81. Wear bushing running and retrieval tool 81 is retrieved by rotating the wear bushing running and retrieval tool 81 one quaruter turn clockwise and pulling straight up to disengage the slips from the inner diameter surface of lead impression wear bushing 11. In this manner, a wear bushing may be set, and pressure tested while also determining the elevation of lock ring grooves 79 in wellhead 77 relative to casing hanger 75 in a single trip.

After subsequent drilling operations through lead impression wear bushing 11, lead impression wear bushing 11 will be removed from wellhead 77, and a lockdown hanger may be run into place and landed at the appropriate elevation to engage lock-ring grooves 79. Retrieval occurs by first landing wear bushing running and retrieval tool 81 on lead impression wear bushing 11. Then, while a weight is maintained on wear bushing running and retrieval tool 81, a left hand torque is applied to engage slips of wear bushing running and retrieval tool 81 with an inner diameter surface of lead impression wear bushing 11. While maintaining the left and torque on wear bushing running and retrieval tool 81, an upward pull is applied to wear bushing running and retrieval tool to pull lead impression wear bushing 11 from its location within the wellhead. A person skilled in the art will understand that the running and retrieval process as described herein with respect to wear bushing running and retrieval tool 81 is exemplary. Any suitable tool configured to run, set, release, and retrieve lead impression wear bushing 11 may be used and is contemplated by the disclosed embodiments. Alternative wear bushing running and retrieval tools may be hydraulically actuated, pneumatically actuated, or engage a differently operating mechanical system when compared to that described herein.

As shown in FIG. 7, lead impression wear bushing 11 may include an anti-rotation pin 83 coupled to a lower rim of lead assembly wear bushing 13. Anti-rotation pin 83 is adapted to insert into a corresponding slot of casing hanger 75 and is of sufficient strength to prevent rotation of lead impression wear bushing 11 relative to casing hanger 75 during subsequent drilling operations performed after setting and testing of lead impression wear bushing 11. In addition, wear bushing 11 includes a seal 85, and an optional latch 87. In the illustrated embodiment, seal 85 comprises a ring in sealing engagement with an exterior surface of the lower end of lead assembly wear bushing 13 and a corresponding inner diameter surface of casing hanger 75. A similar seal 89 may be included on lead actuation wear bushing 15. Seal 89 may seal the upper end of lead actuation wear bushing 15 to wellhead 77.

Where used, latch 87 may be a lockdown "D" ring as shown. Latch 87 will reside within an outer diameter channel formed on a lower end of lead impression wear bushing 13 and have an outer diameter slightly larger than an upper inner diameter rim of casing hanger 75. A first weight may be applied to latch 87 through wear bushing 11 to force latch 87 past the upper inner diameter rim of casing hanger 75 to land in a inner diameter groove of casing hanger 75. Upward pull on wear bushing 11 will cause latch 87 to expand radially outward and latch to a downward facing shoulder of casing hanger 75. Wear bushing 11 may be retrieved by pulling latch 87 past the upward facing shoulder, usually requiring an upward pull greater than the weight applied to set latch 87. Alternative embodiments may not include latch 87. In these alternative embodiments, lead impression wear bushing 11 will be held in place by the force of impression blocks 47 on grooves 79 within wellhead 77.

Accordingly, the disclosed embodiments provide numerous advantages. For example, the disclosed embodiments provide an apparatus that allows for setting a wear bushing while testing the elevation of lock ring grooves in a subsea wellhead. By determining or testing for this elevation while performing other drilling activities, the disclosed apparatus reduces the number of tooling trips needed to properly complete the well. This will save rig time while allowing rig operators to include this step as a standard operational procedure.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A subsea wellhead assembly, comprising:

a subsea wellhead having a bore containing a grooved profile;

a casing hanger landed in the bore below the profile;

a wear bushing that retrievably lands in the bore, shielding the profile and an inner part of the casing hanger from drilling tools that pass through the wear bushing;

an impression block of a deformable material carried by the wear bushing;

an actuator moveable in response to landing of the wear bushing that forces the impression block into the profile to cause the impression block to form an impression of the profile for subsequent inspection when the wear bushing is retrieved;

wherein the wear bushing further comprises:

a first tubular member having an axis;

a second tubular member coaxial with the first tubular member and axially moveable between run-in and sat positions relative to the first tubular member: and wherein movement of the second tubular member to the set position causes the actuator to force the block into the profile to cause the impression block to form an impression of the profile for subsequent inspection when the wear bushing is retrieved.

2. The subsea wellhead assembly of claim 1, wherein the actuator is housed within a window in a tubular wall of the first tubular member; and the second tubular member is disposed axially above the first tubular member and has a lower end that inserts within a bore of the first tubular member when moving to the set position to move the actuator and force the impression block into the profile.

3. The wear bushing of claim 1, wherein:

the first tubular member defines a plurality of vertical slots on an inner diameter surface of the bore;

a plurality of ribs are formed on an exterior surface of a lower end of the second tubular member;

each rib substantially fills a corresponding one of the slots when the lower end of the second tubular member is inserted into the central bore of the first tubular member;

wherein a plurality of shear elements hold the second tubular member in the run-in position relative to the first tubular member during a running operation;

a guide slot is formed in each slot of the plurality of vertical slots in the first tubular member;

a plurality of guide pins are mounted to the second tubular member, each guide pin having an exterior end adapted to fit within a corresponding guide slot of the first tubular member; and wherein the guide pins are further adapted to support the axial weight of the first tubular member during running and retrieval of the wear bushing.

4. The subsea wellhead assembly of claim 1, wherein:

the first tubular member defines a plurality of windows extending from an inner diameter of the first tubular member to an outer diameter of the first tubular member; and the actuator comprises a plurality of lead impression assemblies, each corresponding to and positioned within a separate window of the plurality of windows.

5. The subsea wellhead assembly of claim 4, wherein the lead impression assembly comprises:

piston adapted to move radially within each window of the first tubular member, the piston biased to the retracted position;

a spring mounted to the piston and exerts a spring force radially inward on the piston;

the piston having an interior end adapted to be slidingly engaged by an exterior surface of the second tubular member when the second tubular member moves front the run-in to the set position; and the impression block is coupled to an outer end of the piston.

6. A wear bushing for disposition within a wellhead comprising:

a first tubular member having an axis;

at least one impression assembly housed within the first tubular member and radially moveable between a retracted and an extended position relative to the first tubular member;

a second tubular member coaxial with the first tubular member and axially moveable between run-in and set positions relative to the first tubular member;

wherein movement of the second tubular member to the set position causes the impression assembly to move from the retracted to the extended position into engagement with at wellhead member profile, the Impression assembly having a permanently deformable block for creating an imprint of the profile;

a latch mounted to one of the tubular members to latch the first and second tubular members in the wellhead;

a seal mounted to one of the tubular members to seal the first and second tubular member to the wellhead; and wherein the first and second tubular members have bores sized for the passage of drilling tools.

7. The Wear bushing of claim 6, wherein:

the lead impression assembly is housed within a window in a tubular wall of the first tubular member; and the second tubular member is disposed axially above the first tubular member and has a lower end that inserts within the bore of the first tubular member when moving to the set position.

8. The wear bushing of claim 7, wherein:

the first tubular member defines a plurality of vertical slots on an inner diameter surface of the bore;

a plurality of ribs are formed on an exterior surface of a lower end of the second tubular member: and each rib substantially fills a corresponding one of the slots when the lower end of the second tubular member is inserted into the central bore of the first tubular member.

9. The wear bushing of claim 8, wherein a plurality of shear elements hold the second tubular member in the run-in position relative to the first tubular member during a running operation.

10. The wear bushing of claim 8, wherein:

a guide slot is formed in each slot of the plurality of vertical slots in the first tubular member; and a plurality of guide pins are mounted to the second tubular member, each guide pin having an exterior end adapted to fit within a corresponding guide slot of the first tubular member.

11. The wear hushing of claim 10, wherein the guide pins are further adapted to support the axial weight of the first tubular member during running and retrieval of the wear bushing.

12. The wear bushing of claim 7, wherein the impression assembly comprises:

a piston adapted to move radially within each window of the first tubular member, the piston biased to the retracted position;

the piston having an interior end adapted to be slightly engaged by an exterior surface of the second tubular member when the second tubular member moves from the run-in to the set position; and the block is coupled to an outer end of the piston.

13. The wear bushing of claim 12, wherein a spring is mounted to the piston and exerts a spring force radially inward on the piston.

14. The wear bushing of claim 6, wherein:

the first tubular member defines a plurality of windows extending from an inner diameter of the first tubular member to an outer diameter of the first tubular member: and the impression assembly comprises a plurality of lead impression assemblies, each corresponding to and positioned within a separate window of the plurality of windows.

15. A method performing operations through and in a subsea wellhead, comprising:

(a) mounting an impression block in a wear bushing; then (b) running the wear bushing subsea and landing the wear bushing within the wellhead such that the impression block is adjacent a selected profile within the wellhead:

(c) moving the impression block outward and deforming the impression block against the profile in the wellhead;

(d) lowering is drill string through the wear bushing and wellhead and rotating the drill string to perform drilling activities;

(e) retrieving the wear bushing along, with the deformed impression block;

(f) inspecting the impression Hock to ascertain a location of the profile; and wherein step (c) occurs in response to landing of the wear bushing in the wellhead.

16. The method of claim 15, wherein step (c) comprises applying weight to the wear bushing, which causes an upper portion of the wear bushing to move downward relative to a lower portion.

17. The method of claim 15, wherein step (c) further comprises pressure testing the wear bushing.

18. The method of claim 15, wherein step (b) comprises landing, the wear bushing on a casing hanger located in the subsea wellhead.

* * * * *